US006139587A

United States Patent [19]

Nair et al.

[11] Patent Number: 6,139,587

[45] Date of Patent: Oct. 31, 2000

[54] WET CLEANING OF DELICATE, NON-STRUCTURED GARMENTS WITH MINIMIZED WRINKLING, SHRINKAGE AND COLOR DAMAGE

[75] Inventors: Harikrishnan Achuthan Nair, Mason; Melissa LeAnn Campbell, West Chester, both of Ohio

[73] Assignee: The Procter & Gamble Company, Cincinnati, Ohio

[21] Appl. No.: 09/424,373

[22] PCT Filed: May 18, 1998

[86] PCT No.: PCT/IB98/00752

§ 371 Date: Mar. 9, 2000

§ 102(e) Date: Mar. 9, 2000

[87] PCT Pub. No.: WO98/53131

PCT Pub. Date: Nov. 26, 1998

Related U.S. Application Data

[60] Provisional application No. 60/047,616, May 23, 1997.

[51] Int. Cl.[7] ..... D06L 1/00

[52] U.S. Cl. ..... 8/138; 8/147; 510/305; 510/326; 510/337; 510/393

[58] Field of Search ..... 8/137, 147; 510/305, 510/317, 320, 326, 331, 337, 340, 356, 374, 393

[56] References Cited

U.S. PATENT DOCUMENTS

| | | | |
|---|---|---|---|
| 5,762,647 | 6/1998 | Brown et al. | 8/137 |
| 6,053,952 | 4/2000 | Kaiser | 8/142 |

*Primary Examiner*—Yogendra Gupta
*Assistant Examiner*—Derrick G. Hamlin
*Attorney, Agent, or Firm*—Brian M. Bolam

[57] ABSTRACT

A method for laundering non-structured garments which are unsuitable for water washing and which are to be cleaned without wrinkling, shrinkage or color damage.

1 Claim, No Drawings

WET CLEANING OF DELICATE, NON-STRUCTURED GARMENTS WITH MINIMIZED WRINKLING, SHRINKAGE AND COLOR DAMAGE

This application is a 371 of PCT/IB98/00752 filed May 18, 1998 which claims benefit to U.S. provisional application 60/047,616 filed May 23, 1997.

TECHNICAL FIELD

This invention relates to a method for laundering delicate garments made of fabrics which can be damaged via conventional laundry operations. Such a method involves soaking of the garments in a certain type of surfactant-containing aqueous solution under specific conditions, followed by rinsing, dewatering and drying steps.

BACKGROUND OF THE INVENTION

Laundering of soiled or stained garments using aqueous, surfactant-containing washing solutions has taken place for centuries. Such an operation generally involves contacting the soiled/stained garments to be cleaned with a washing solution to solubilize or otherwise dislodge and remove the soil or stain producing material from the fabric of the garment. The washing step is generally followed by rinsing of washed garments in water to remove the surfactant-containing washing solution. After rinsing one or more times, rinse water is then removed from the garments by one or more types of drying steps.

In modern times, the washing, rinsing and some water removal steps of the laundering procedure have generally been carried out in an automatic washing machine. Washing machines utilize a mechanical agitator to produce agitation of washing and rinsing solutions. Automatic washing machines are also fitted with means for controlling wash and rinse water temperatures and wash and rinse duration. Automatic washing machines can also provide the means for both forming and removing washing and rinsing solutions by using filling and draining apparatus and filling, draining and/or spin cycles.

Soil and stain removal from garments can generally be enhanced by agitating the washing solution as it contacts the garments to be cleaned. Elevated washing temperatures and prolonged contact of garments with the washing solution also facilitate stain and soil removal. Agitated, high temperature and prolonged rinsing can also improve the effectiveness of garment laundering.

Unfortunately, the very procedures and conditions which enhance the effectiveness of soil and stain removal during conventional laundering of garments can also damage the structural integrity and appearance of certain types of garments being laundered. Garments fashioned from such fabrics as silk, wool, rayon, acetate or ramie tend to wrinkle, shrink, fade or lose color when they are subjected to agitated, high temperature or prolonged washing conditions and then dried. Accordingly, garments made from such fabrics are frequently labeled as "dry clean only" or "hand wash only" and therefore require special procedures for their cleaning. For example, garments with a "dry clean only" requirement are generally cleaned via a dry cleaning operation which employs nonaqueous cleaning solvents and which is generally performed professionally outside the home. This can, of course, be a time consuming, disruptive, and expensive way of cleaning these garments, especially if such garments must be frequently laundered.

Given the foregoing, there is clearly a continuing and ongoing need to develop simple, aqueous laundering procedures for delicate, damagable garments and for such procedures to strike an appropriate balance between effective stain and soil removal and minimized fabric damage, decoloring and wrinkling. Accordingly, it is an object of the present invention to provide a method for the aqueous, laundering of delicate garments which are generally unsuitable for water washing.

It is the further objective of this invention to provide such a method that effectively cleans such garments but without causing unacceptable wrinkling, shrinkage or color damage.

It is the further objective of this invention to provide such a method which can be carried out in the home using conventional automatic washing machine devices and procedures.

Such objectives can be realized by means of the five step method described herein and claimed hereinafter.

SUMMARY OF THE INVENTION

The present invention provides a method for laundering non-structured garments which are generally unsuitable for water washing. Such garments are generally those made from wool, silk, acetate, ramie or rayon. They can be cleaned without unacceptable wrinkling, shrinkage or color damage by means of a specific five step method.

In the first step of the method herein, an aqueous soaking solution is formed having a pH ranging from about 4 to 9 and comprising several essential ingredients. In the second method step, the garments to be cleaned are soaked without agitation in this soaking solution at a temperature from about 5° C. to 20 ° C. for a period from about 5 to 30 minutes. In the third step of the method, this soaking solution is drained from the garments without agitation and replaced with an aqueous rinse bath. In the fourth method step, the aqueous rinse bath is drained from the garments without agitation, and water is removed therefrom such that the garments have a retained water content of from about 5% to 25% by weight. Finally, in the fifth method step, the dewatered garments are hung or laid flat to allow substantially all of the remaining water to evaporate from them.

The aqueous soaking solution, which is key to the practice of the method herein, comprises from about 50 to 450 ppm of certain types of nonionic surfactants, from about 50 to 350 ppm of certain types of co-surfactants and from about 5 to 40 ppm of one or more functional additives. The nonionic surfactants essentially used in the soaking solution are the $C_{8-18}$ alcohol ethoxylates having from about 1 to 15 moles of ethylene oxide per molecule, $C_{8-18}$ polyhydroxy fatty acid amides or $C_{1-18}$ amine oxide semi-polar nonionics. Combinations of these nonionic surfactants may also be employed.

The co-surfactant used to form the soaking solution used in the method herein can comprise certain anionic surfactants, certain cationic surfactants or both. Utilizable anionic surfactants include the $C_{8-18}$ alkyl sulfates, the $C_{8-18}$ alkyl ether sulfates having from about 1 to 6 moles ethylene oxide per molecule, and the $C_{9-16}$ alkylbenzene sulfonates. The cationic surfactants which may be used as the co-surfactant in the aqueous soaking solution comprise quaternized $C_{6-12}$ surfactant amines such as amidopropyl amines or mono- or di- $C_{8-22}$ alkyl quaternary ammonium salts.

The functional additives used in the aqueous soaking solution can be detergency builders, protease enzymes, other detergent enzymes, clay soil dispersing agents, dye transfer inhibition agents and/or optical brighteners. By using such an aqueous soaking solution in conjunction with the procedural steps hereinbefore described, delicate garments can be effectively cleaned without causing unacceptable wrinkling, shrinkage or color damage.

DETAILED DESCRIPTION OF THE INVENTION

The five steps in the garment laundering method of the present invention are described in details as follows. All concentrations and ratios provided are on a weight basis unless otherwise specified.

A) Aqueous Soaking Solution Formation

The first step in the wet cleaning method herein involves the formation of an aqueous soaking solution in which the garments to be cleaned will initially be soaked. This aqueous soaking solution will contain certain specified nonionic surfactants, certain specified co-surfactants and one or more additional functional additives.

1) Nonionic Surfactant

The nonionic surfactant component will comprise from about 50 to 450 ppm of the aqueous soaking solution. More preferably, nonionic surfactant will comprise from about 100 to 400 ppm of the aqueous soaking solution. The nonionic surfactants employed are selected from certain alcohol ethoxylates, polyhydroxy fatty acids amides, amine oxide semi-polar nonionics and combinations of these nonionic surfactant types.

The alcohol ethoxylates useful in forming the aqueous soaking solution are those which correspond to the general formula:

$$R^1\text{-O-}(C_2H_4O)_nSO_3M$$

wherein $R^1$ is a $C_8$–$C_{18}$ alkyl group and n ranges from about 1 to 15. Preferably $R^1$ is an alkyl group, which may be primary or secondary, that contains from about 9 to 15 carbon atoms, more preferably from about 10 to 14 carbon atoms. Preferably the ethoxylated fatty alcohols will contain from about 2 to 12 ethylene oxide moieties per molecule, more preferably from about 8 to 12 ethylene oxide moieties per molecule. The ethoxylated fatty alcohol nonionic surfactant component of the aqueous soaking solution will frequently have a hydrophilic-lipophilic balance (BLB) which ranges from about 6 to 15, most preferably from about 10 to 15.

Examples of fatty alcohol ethoxylates useful as the nonionic surfactant component of the aqueous soaking solution used herein will include those which are made from alcohols of 12 to 15 carbon atoms and which contain about 7 moles of ethylene oxide. Such materials have been commercially marketed under the tradenames Neodol 25-7 and Neodol 23-6.5 by Shell Chemical Company. Other useful Neodols include Neodol 1-5, ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful forming the aqueous soaking solution used in this invention are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

Another type of nonionic surfactant which can be incorporated into the aqueous soaking solution used herein comprises the $C_{8-18}$, preferably $C_{10-16}$, polyhydroxy fatty acid amides. These materials are more filly described in Pan/Gosselink; U.S. Pat. No. 5,332,528; Issued Jul. 26, 1994, which is incorporated herein by reference. These polyhydroxy fatty acid amides have a general structure of the formula:

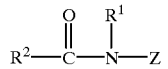

wherein $R^1$ is H, $C_1$–$C_4$ hydrocarbyl, 2-hydroxyethyl, 2-hydroxypropyl, or a mixture thereof, $R^2$ is $C_8$–$C_{18}$ hydrocarbyl; and Z is a polyhydroxylhydrocarbyl having a linear hydrocarbyl chain with at least 3 hydroxyls directly connected to the chain, or an alkoxylated derivative thereof Examples of such surfactants include the $C_{10}$–$C_{18}$ N-methyl, or N-hydroxypropyl, glucamides. The N-propyl through N-hexyl $C_{12}$–$C_{16}$ glucamides can be used to make fewer suds as the aqueous soaking solution is formed.

Another type of nonionic surfactant which can be used in the aqueous soaking solution herein comprises amine oxide semi-polar nonionics. These materials have the formula

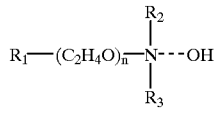

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

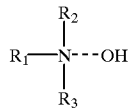

wherein $R_1$ is a $C_{12-16}$ alkyl and $R_2$ and $R_3$ are methyl or ethyl. The above semi-polar amine oxides are more fully described in U.S. Pat. No. 4,316,824, incorporated herein by reference.

2) Anionic and/or Cationic Co-surfactant

In addition to one or more of the hereinbefore described nonionic surfactants, the aqueous soaking solution will also contain a co-surfactant which can be anionic or cationic in nature. The co-surfactant component may also comprise combinations of anionic and cationic surfactants. This co-surfactant will be present in the aqueous soaking solution to the extent of from about 50 to 350 ppm. More preferably, the co-surfactant will be present to the extent of from about 100 to 300 ppm in the aqueous soaking solution.

The co-surfactant can be an anionic surfactant. Alkyl sulfates, alkyl ether sulfates and alkyl benzine sulfates are useful anionic surfactant materials that may be employed.

Alkyl sulfate anionic surfactants can be primary or secondary materials produced by the sulfation of higher $C_{8-18}$ fatty alcohols. Conventional primary alkyl sulfate surfactants have the general formula:

$$ROSO_3\text{-}M^+$$

wherein R is typically a linear $C_{8-18}$ hydrocarbyl group, which may be straight chain or branched chain, and M is a water-solubilizing cation. Preferably R is a $C_{10-15}$ alkyl, and M is alkali metal. Most preferably R is $C_{12-14}$ and M is sodium.

Conventional secondary alkyl sulfates may also be utilized: Secondary alkyl sulfates are described in greater detail in Dauderman et al; U.S. Pat. No. 5,587,356; Issued Dec. 24, 1996. This patent is incorporated herein by reference.

Anionic co-surfactants useful in forming the aqueous soaking solution also include the alkyl ether sulfates. Alkyl ether sulfates are also known as alkyl polyethoxylate sulfates. These ethoxylated alkyl sulfates are those which correspond to the formula:

$$R'\text{-}O\text{-}(C_2H_4O)_nSO_3M$$

wherein R' is a $C_8$–$C_{18}$ alkyl group, n is from about 1 to 6, and M is a salt-forming cation. Preferably, R' is $C_{10-16}$ alkyl, n is from about 1 to 4, and M is sodium, potassium, ammonium, alkylammonium, or alkanolammonium. Most preferably, R' is $C_{12}$–$C_{16}$, n is from about 1 to 3 and M is sodium. The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0.

Anionic co-surfactants useful in forming the aqueous soaking solution also include the alkyl benzene sulfonates. These are the alkali metal salts of alkylbenzene sulfonic acids in which the alkyl group contains from about 9 to 16 carbon atoms, in straight chain or branched chain configuration. (See U.S. Pat. Nos. 2,220,099 and 2,477,383 incorporated herein by reference.) Especially preferred are the sodium and potassium linear straight chain alkybenzene sulfonates (LAS) in which the average number of carbon atoms in the alkyl group is from about 11 to 14. Sodium $C_{11}$–$C_{14}$ LAS is especially preferred.

The co-surfactant component utilized in the aqueous soaking solution may also comprise a cationic surfactant. Suitable cationic surfactants include certain quaternized surfactant amines and certain mono- or di-long chain quaternary ammonium salts.

The surfactant amines useful as a cationic surfactant in the aqueous soaking solution herein are described by the formula:

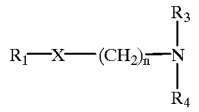

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$-$CH_2$-O($R_5$)) wherein $R_5$ is H or methyl.

Preferred surfactant amines include the following:

$R_1$-$(CH_2)_2$-$NH_2$;

$R_1$-O-$(CH_2)_2$-$NH_2$;

$R_1$-C(O)-NH-$(CH_2)_3$-$N(CH_3)_2$; and

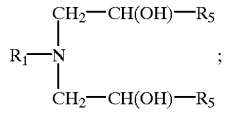

wherein $R_1$ is a $C_6$–$C_{12}$ alkyl group and $R_5$ is H or $CH_3$.

In a highly preferred embodiment, the surfactant amine is described by the formula:

$R_1$-C(O)-NH-$(CH_2)_3$-$N(CH_3)_2$ wherein $R_1$ is $C_8$–$C_{12}$ alkyl.

Particularly preferred surfactant amines include those selected from the group consisting of octyl amine, hexyl amine, decyl amine, dodecyl amines, $C_8$–$C_{12}$ bis (hydroxyethyl)amine, $C_8$–$C_{12}$ bis-(hydroxyisopropyl) amine, and $C_8$–$C_{16}$, preferably $C_8$–$C_{12}$, amidopropyl dimethyl amine, and mixtures of these amines.

The surfactant amines hereinbefore described will generally be quaternized, e.g., protonated, in the aqueous soaking solutions used in the cleaning method of this invention. Such surfactant amines are thus characterized herein as being cationic in nature.

Other cationic surfactants which may be employed as the co-surfactant in the aqueous soaking solution herein are the quaternary ammonium cationic surfactants of the formula:

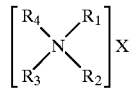

wherein $R_1$ and $R_2$ are individually selected from the group consisting of $C_1$–$C_4$ alkyl, $C_1$–$C_4$ hydroxy alkyl, and —$(C_2H_4O)_xH$ where x has a value from 2 to 5; X is an anion; and (1) $R_3$ and R4 are each a $C_8$–$C_{14}$ alkyl or (2) $R_4$ is a $C_8$–$C_{22}$ alkyl and $R_3$ is selected from the group consisting of $C_1$–$C_{10}$ alkyl, $C_1$–$C_{10}$ hydroxy alkyl, and —$(C_2H_4O)_xH$ where x has a value from 2 to 5.

Preferred of the above are the mono-long chain alkyl quaternary ammonium surfactants wherein the above formula $R_1$, $R_2$, and $R_3$ are each methyl, and $R_4$ is a $C_8$–$C_{18}$ alkyl. The most preferred quaternary ammonium surfactants are the chloride, bromide and methylsulfate $C_8$–$C_{16}$ alkyl trimethyl ammonium salts, and $C_8$–$C_{16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred. ADOGEN 412™, a lauryl trimethyl ammonium chloride commercially available from Witco, is a preferred quaternary ammonium cationic surfactant.

3) Functional Additives

The aqueous soaking solution used in the method of this invention will also contain one or more conditional functional additives. Such additives can be detergency builders, protease enzymes, other detergent enzymes, clay soil dispersing agents, dye transfer inhibition agents and/or optical brighteners. Functional additives will generally be present in the aqueous soaking solution to the extent of from about 5 to 40 ppm, more preferably from about 5 to 35 ppm. Each type of these additional functional additives is described in detail as follows:

a) Builders

Suitable organic detergency builders include the alkali metal citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, $C_{10}$–$C_{22}$ fatty acids and citric acid. Other examples are organic phosphonate type sequestering agents such as those which have been sold by Monsanto under the Dequest® tradename and alkanehydroxy phosphonates. Citrate salts and $C_{12}$–$C_{18}$ fatty acid soaps are highly preferred. Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan® trademark.

Suitable inorganic detergency builders include the alkali metal phosphates, carbonates, borates, silicates, and aluminosilicates. Sodium carbonate, sodium tripolyphosphate and sodium aluminosilicates are preferred.

b) Protease Enzyme

Examples of suitable protease enzymes are the subtilisins which are obtained from particular strains of *B. subtilis* and *B. licheniforms*. Such protease enzymes are described in greater detail in GB 1,243,784; EP 130,756A; EP 303,761A; WO 97/18140A, WO 93/03529A; WO 95/10591A; WO 95.07791; and WO 94/25583. All of these patent publications are incorporated herein by reference. Suitable protease materials are marketed under the tradenames Esperase® (Novo), Alcalase® (Novo), Savinase® (Novo) and Maxatase® (International Bio-Synthetics).

c) Other Detergent Enzymes

Other types of detergent enzymes are well known and may also be used as one of the functional additives incorporated into the aqueous soaking solutions herein. These non-protease enzyme types include amylases, cellulases, lipases and peroxidases.

Amylases (α and β) may be used for removal of carbohydrate-based stains. These amylase enzymes may be of any subtilisin origin such as vegetable, animal, bacterial, fungal or yeast origin. Amylase enzymes are described in greater detail in WO 95/26397A; GB 1,296,839; WO 94/02597A; WO 94/18314; and WO 95/09909A. All of these patent publications are incorporated herein by reference. Suitable amylase materials are marketed when the tradenames Termamyl® (Novo), Fungamyl® (Novo), BAN® (Novo), Rapidase® (International Bio-Synthetics) and Duramyl® (Novo).

Cellulase enzymes usable in the aqueous soaking solution include both bacterial and fungal cellulases. Preferably, they will have a pH optimum of between 5 and 9.5. Suitable cellulases are disclosed in U.S. Pat. No. 4,435,307, Barbesgoard et al, Issued Mar. 6, 1984. This patent is incorporated by reference. It discloses fungal cellulase produced from Humicola insolens and Humicola strain DSM 1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2,075,028; GB-A-2,095,275 and DE-OS-2,247,832. CAREZYM® (Novo) is an especially useful cellulase.

d) Clay Soil Dispersing Agents

Useful clay soil dispersing agents include the water-soluble ethoxylated amines having clay soil removal and anti-redeposition properties. The most preferred clay soil removal/anti-redeposition agent is ethoxylated tetraethylenepentamine. Exemplary ethoxylated amines are further described in VanderMeer; U.S. Pat. No. 4,597,898; Issued Jul. 1, 1986. Another group of preferred clay soil removal/anti-redeposition agents comprises the cationic compounds disclosed in Oh and Gosselink; European Patent Publication EP-A-111,965; Published Jun. 27, 1984. Other such agents include the ethoxylated amine polymers disclosed in Gosselink; European Patent Publication EP-A-111,984; Published Jun. 27, 1984. All of these patent publications are incorporated herein by reference. Other useful dispersants include the polyacrylates described in Diehl, U.S. Pat. No. 3,308,067; Issued Mar. 7, 1967 and the acrylate/maleate co-polymers disclosed in European Patent Publication EP-A-066,915, Published Dec. 15, 1982.

e) Dye Transfer inhibition Agents

Dye Transfer Inhibition (DTI) agents useful in the aqueous soaking solutions of this invention are materials effective for inhibiting the transfer of dyes from one fabric to another during the soaking step of the method herein. Generally, such dye transfer inhibiting agents include polyvinylpyrrolidone polymers, polyamine N-oxide polymers, copolymers of N-vinylpyrrolidone and N-vinylimidazole, manganese phthalocyanine, peroxidases, and mixtures thereof. Preferred DTI agents include poly (4-vinylpyridine-N-oxide) having a molecular weight of about 50,000 and an amine to an amine-N-oxide molar ratio of about 1:4 (known as "PVNO") and copolymers of N-vinylpyrrolidone and N-vinylimidazole (known as "PVPVI"). These materials are described in greater detail in Fredj et al; U.S. Pat. No. 5,458,809; Issued Oct. 17, 1995 and in White; U.S. Pat. No. 5,451,341; Issued Sep. 19, 1995, both incorporated herein by reference.

f) Optical Brighteners

Optical Brighteners or whitening agents may also be included in the aqueous soaking solutions herein. Commercial optical brighteners which may be usefull in the present invention can be classified into subgroups, which include, but are not necessarily limited to, derivatives of stilbene, pyrazoline, coumarin, carboxylic acid, methinecyanies, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982) and in U.S. Pat. No. 4,790,856, issued to Wixon on Dec. 13, 1988. Both of these publications are incorporated herein by reference.

4) Soaking Solution pH

The aqueous soaking solution used in the garment cleaning method herein must be maintained at a pH between about 4 and 9. More preferably, soaking solution pH will range from about 4.5 to 7.5. To achieve the requisite pH conditions, materials which adjust or maintain solution pH, e.g., NaOH or sodium carbonate, may need to be added.

5) Soaking Solution Preparation

The aqueous soaking solutions used herein can be prepared by simply adding the hereinbefore described ingredients to water in amounts sufficient to provide the requisite concentration of each ingredient in the soaking solution. Such components can be added to the soaking solutions individually and separately. More preferably, however, the several components of the soaking solution to be prepared will be combined together in a concentrated product prior to their addition to water to form the aqueous soaking solution. Such concentrated products can be in either granular or liquid form. These products should contain the soaking solution ingredients in concentrations and ratios such that the requisite concentrations of all ingredients are provided in the soaking solution when such concentrated precursor products are added to water.

The aqueous soaking solutions can be formed in any suitable vessel that will contain enough solution in which to soak the number and type of garments that are to be cleaned. Thus, the soaking solution may be formed in a wash tub, a laundry tub, a sink or a bathtub. More preferably, however, the aqueous soaking solutions herein will be formed in the tub of an automatic home washing machine. The washing machine agitator can then be used to mix the solution components thoroughly with water to form the soaking solution for use in the method herein. Typical amounts of soaking solution formed will range from about 20 to 60 liters, more preferably from about 30 to 50 liters.

B) Garment Soaking Step

The aqueous soaking solution formed in Step A as hereinbefore described is used to soak the non-structured garments to be cleaned using the method herein. For purposes of this invention, non-structured garments of those which are not lined or are otherwise not composite structures fashioned from more than one type of fabric. Thus, for example, non-structured garments will not include suit coats or sport jackets or lined skirts. Non-structured garments will include unlined sweaters, blouses, shirts, skirts, slacks, pants, and the like.

Garments that are best suited for cleaning via the method herein are those fashioned from fabrics that may be susceptible to damage by more conventional laundering methods. They thus include garments made from silk, wool, acetate, ramie or rayon.

The garments to be cleaned are contacted with the aqueous soaking solution hereinbefore described for a period of from about 5 to 30 minutes. More preferably, a soaking period from about 10 to 15 minutes is used. During the soaking step, relatively low soaking solution temperatures are employed. Thus, temperature of the aqueous soaking solution is generally maintained between about 5° C. and 20° C. More preferably, temperature of the soaking solution will be maintained between about 12° C. and 15° C.

During the soaking step, it is important that the soaking solution containing the garments not be agitated or excessively mixed. Agitation or mixing can damage the fibers, finish and/or color of the types of garments used in the method herein. Thus, even though the aqueous soaking solution may have been agitated to effect its preparation, the soaking solution during the soaking step should remain substantially unagitated.

Also during the soaking step, it may be desirable to place the garments being cleaned in a water permeable, bag, such as a nylon mesh bag, or other flexible or rigid container. This serves to reduce even further the fabric-damaging forces to which the garments may be subjected during this soaking step or subsequent steps of the method hereinafter described.

The aqueous soaking solution is preferably used in the soaking step in a ratio of soaking solution to garments of from about 15:1 to 1:1. More preferably a solution to garment ratio of from about 10:1 to 1:1 is employed.

C) Solution Draining/Garment Rinsing Step

After Soaking Step B has been carried out for the requisite time period, the aqueous soaking solution is drained from the soaking garments without agitation and then replaced with an aqueous rinse bath. Draining of the Step A soaking solution from the soaking garments may be carried out by simply pouring the soaking solution out of the soaking vessel, by allowing the soaking solution to drain from the soaking vessel through a drain hole in the bottom of the soaking vessel or by gently removing the soaking garments from the soaking vessel and placing them in a separate rinsing vessel. If the soaking vessel used is the tub of an automatic washing machine, the draining of the soaking solution may also be carried out by running the machine through a brief (0.5 to 2 minutes) spin cycle.

Once the soaking solution has been drained from the garments, it is replaced with an aqueous rinse bath. Frequently, this will involve replacing the soaking solution with an equivalent amount of rinse water. The rinse step need be carried out only once, but it is possible to repeat the draining and rinsing steps more than once in order to have several cycles of rinsing. During the rinse step, temperature of the rinse bath may range from about 5° C. to 20° C. Rinse water can be contacted with the garments for a period of from about 2 to 5 minutes. The garments being cleaned are preferably kept in a water permeable, flexible retaining bag or other constraining container during this solution draining/garment rinsing step.

D) Rinse Draining

After the solution draining and garment rinsing step (Step C) has been completed, the rinse water is then drained from the garments being laundered. As in the solution draining/garment rinsing stage, draining of the rinse bath is to take place without substantial agitation. Rinse water may be removed from the garments via any of the same ways that the soaking solution can be removed from the garments as in Step C. Preferably, garments to be cleaned in an automatic washing machine will be subjected to a gentle spin cycle. Alternatively, garments may be removed from the rinse bath and gently wrung by hand. Again during all of the rinse draining procedures, the garments may be kept in the water-permeable retaining bag or other suitable container.

In this Rinse Draining Step D, the garments being cleaned will be subjected to procedures that remove water to the extent that the garments have a retained water content from about 5% to 25%. More preferably, at the conclusion of this Rinse Draining Step D, the garments will have a residual water content of from about 10% to 20%.

E) Unstressed Garment Drying

After conclusion of the Rinse Draining Step D, the dewatered garments are subjected to conditions that serve to complete the drying of the gaments while subjecting the garments to substantially no tumbling, compressive or stress forces beyond gravity. Thus, the garments to be dried will generally be placed on hangers or laid out flat, e.g., blocked, to allow substantially complete removal of water therefrom via evaporation. Temperatures during this garment drying step should generally not exceed 25° C.

The method of this invention provides a procedure for the in-home cleaning of garments that would otherwise need to be dry-cleaned. The following example illustrates the in-home wet cleaning method of the present invention.

EXAMPLE

A liquid wet cleaning formulation is prepared having the following composition:

| Component | Wt. % |
|---|---|
| $C_{12-13}$ Alcohol ethoxylate (EO = 9) | 25% |
| Lauryl trimethyl ammonium chloride | 2% |
| Protease enzyme | 0.05% |
| PVNO* | 0.1% |
| Citric acid | 6% |
| Perfume | 0.4% |
| Water | Balance to 100% |

*Poly(4-vinylpyridine-N-oxide) with MW = 50,000; and Amine/Amine N-oxide Molar Ratio = 1:4

Approximately 30 ml of this liquid wet cleaning product are added to a Kenmore automatic washing machine containing 12 gallons (45.4 liters) of water. This provides an aqueous soaking solution in the tub of the washing machine. Such a solution contains 350 ppm of the alcohol ethoxylate and 40 ppm of the quaternary of ammonium salt. This soaking solution has a pH of 5.

Previously worn, and hence body-soiled, garments are selected for use in the wet cleaning method. Garments that are used include a rayon blouse, a silk blouse and a wool sweater. These garments have a total weight of 3 pounds (1.5 kg.). The garments are folded in a mesh garment bag so that the garments retain their folded configuration. The bag full of garments is then submerged in the soaking solution and maintained there without agitation for approximately 15 minutes. Soaking solution is at room temperature (20° C.).

After 15 minutes, the soaking solution is drained from the washing machine tub and replaced with fresh rinse water. After two minutes, the fresh rinse water is drained, and the machine is set to spin cycle to remove excess water such that the retained water concentration in the garments is approximately 20%.

The garments are removed from the bag and laid flat to dry. The garments are substantially clean, unshrunk and not faded. Minimal touch up ironing is required.

What is claimed is:

1. A method for laundering non-structured garments which are unsuitable for water washing and which are to be cleaned without wrinkling, shrinkage or color damage, said method characterized by:

A) forming an aqueous soaking solution having a pH from 4 to 9 and characterized by
  1) from 50 ppm to 450 ppm of a nonionic surfactant selected from
    a) $C_{8-18}$ alcohol ethoxylates having from 1 to 15 moles of ethylene oxide per molecule;
    b) $C_{8-18}$ polyhydroxy fatty acid amides;
    c) $C_{8-18}$ amine oxide semi-polar nonionics; and
    d) combinations of said nonionic surfactants;
  2) from 50 ppm to 350 ppm of a co-surfactant selected from
    a) anionic surfactants selected from the group consisting of
      i) $C_{8-18}$ alkyl sulfates;
      ii) $C_{8-18}$ alkyl ether sulfates having from 1 to 6 moles of ethylene oxide per molecule; and
      iii) $C_{9-16}$ alkyl benzene sulfonates;
    b) cationic surfactants selected from the group consisting of
      i) quaternized $C_{6-12}$ surfactant amines;
      ii) mono- or di- $C_{8-22}$ alkyl quaternary ammonium salts; and
    c) combinations of said anionic and cationic co-surfactants; and
  3) from 5 ppm to 40 pm of one or more functional additives selected from detergency builders, protease enzymes, other detergent enzymes, clay soil dispersing agents, dye transfer inhibition agents and optical brighteners;

B) soaking non-structured wool, silk, acetate, ramie or rayon garments to be cleaned in the unagitated soaking solution formed in Step A at a temperature of from 5° C. to 20° C. for a period of from 5 to 30 minutes;

C) draining said soaking solution from said garments without agitation and replacing said drained soaking solution with an aqueous rinse bath;

D) draining said aqueous rinse bath from said garments without agitation to remove water to the extent that said garments have a retained water content of from 5% to 25% by weight; and E) hanging or laying said garments flat to allow substantially all of the remaining water to evaporate therefrom.

* * * * *